US011147423B2

(12) United States Patent
Hyun et al.

(10) Patent No.: US 11,147,423 B2
(45) Date of Patent: Oct. 19, 2021

(54) DUST COLLECTOR AND CLEANER HAVING THE SAME

(71) Applicant: LG ELECTRONICS INC., Seoul (KR)

(72) Inventors: Kietak Hyun, Seoul (KR); Sangchul Lee, Seoul (KR); Changgun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 293 days.

(21) Appl. No.: 15/940,582

(22) Filed: Mar. 29, 2018

(65) Prior Publication Data

US 2019/0090709 A1 Mar. 28, 2019

(30) Foreign Application Priority Data

Sep. 22, 2017 (KR) ..... 10-2017-0122600

(51) Int. Cl.
*A47L 9/16* (2006.01)

(52) U.S. Cl.
CPC ..... *A47L 9/1683* (2013.01); *A47L 9/165* (2013.01); *A47L 9/1608* (2013.01); *A47L 9/1625* (2013.01); *A47L 9/1641* (2013.01); *A47L 9/1658* (2013.01); *A47L 9/1666* (2013.01); *A47L 9/1616* (2013.01)

(58) Field of Classification Search
USPC ..... 15/353
See application file for complete search history.

(56) References Cited

U.S. PATENT DOCUMENTS

| | | | |
|---|---|---|---|
| 2,553,175 | A | 5/1951 | Davenport |
| 3,074,218 | A | 1/1963 | O'Dell |
| 3,375,058 | A | 3/1968 | Petersen |
| 3,386,588 | A | 6/1968 | Ades |

(Continued)

FOREIGN PATENT DOCUMENTS

| | | |
|---|---|---|
| EP | 3000371 | 3/2016 |
| KR | 10-0844621 | 7/2008 |

(Continued)

OTHER PUBLICATIONS

PCT International Search Report dated Feb. 22, 2018 issued in Application No. PCT/KR2017/011379.

(Continued)

*Primary Examiner* — Katina N. Henson
(74) *Attorney, Agent, or Firm* — Ked & Associates LLP

(57) ABSTRACT

A dust collector includes a housing configured to form an outer appearance of the dust collector; a cyclone formed inside the housing to cause a swirling flow to separate dust from air introduced into the housing; axial inlet type swirl tubes configured to receive air and fine dust that have passed through the cyclone, and cause a swirling flow to separate the fine dust from the air; and a mesh configured to surround an outside of the axial inlet type swirl tubes to form a boundary between the cyclone and the axial inlet type swirl tubes, wherein the axial inlet type swirl tubes are stacked in multiple stages, and the axial inlet type swirl tubes in each stage are radially arranged such that the inlet faces an inner surface of the mesh and the outlet faces the center of a region defined by the housing.

20 Claims, 7 Drawing Sheets

(56) References Cited

U.S. PATENT DOCUMENTS

| | | | | |
|---|---|---|---|---|
| 3,425,192 | A | 2/1969 | Davis | |
| 3,541,766 | A | 11/1970 | Wilson | |
| 3,747,306 | A | 7/1973 | Wikdahl | |
| 3,915,679 | A | 10/1975 | Roach | |
| 4,537,608 | A | 8/1985 | Koslow | |
| 4,702,846 | A | 10/1987 | Ryynanen | |
| 5,129,124 | A | 7/1992 | Gamou | |
| 5,403,367 | A | 4/1995 | De Villiers | |
| 5,681,450 | A | 10/1997 | Chitnis | |
| 7,462,212 | B2 | 12/2008 | Han | |
| 7,604,674 | B2 * | 10/2009 | Han | A47L 9/1641 15/347 |
| 7,655,058 | B2 | 2/2010 | Smith | |
| 7,770,256 | B1 | 8/2010 | Fester | |
| 7,799,106 | B2 | 9/2010 | Rother | |
| 7,803,205 | B2 | 9/2010 | Oh | |
| 7,976,597 | B2 | 7/2011 | Smith | |
| 8,101,001 | B2 | 1/2012 | Qian | |
| 8,262,761 | B2 | 9/2012 | Babb | |
| 8,657,904 | B2 | 2/2014 | Smith | |
| 8,914,941 | B2 | 12/2014 | Kim | |
| 2003/0057151 | A1 | 3/2003 | Kopec | |
| 2007/0234691 | A1 | 10/2007 | Han | |
| 2008/0190080 | A1 | 8/2008 | Oh | |
| 2009/0031524 | A1 | 2/2009 | Courtney | |
| 2009/0265883 | A1 | 10/2009 | Reed | |
| 2010/0005617 | A1 | 1/2010 | Hyun et al. | |
| 2010/0115727 | A1 | 5/2010 | Oh | |
| 2010/0275561 | A1 * | 11/2010 | Lundquist | B04C 3/00 55/456 |
| 2013/0031878 | A1 | 2/2013 | Menssen | |
| 2013/0255203 | A1 | 10/2013 | Muenkel | |
| 2014/0373490 | A1 | 12/2014 | Wuebbeling | |
| 2016/0088988 | A1 | 3/2016 | Eo | |
| 2017/0247896 | A1 | 8/2017 | Hayes | |

FOREIGN PATENT DOCUMENTS

| | | | |
|---|---|---|---|
| KR | 10-2010-0093446 | 8/2010 | |
| KR | 10-2015-0031304 | 3/2015 | |
| KR | 10-2015-0109045 | 10/2015 | |
| KR | 10-2016-0089201 | 7/2016 | |
| WO | WO-2016117893 A1 * | 7/2016 | A47L 9/108 |

OTHER PUBLICATIONS

PCT International Search Report dated Feb. 22, 2018 issued in Application No. PCT/KR2017/011380.

PCT International Search Report dated Feb. 22, 2018 issued in Application No. PCT/KR2017/011381.

PCT International Search Report dated Feb. 22, 2018 issued in Application No. PCT/KR2017/011382.

United States Notice of Allowance dated Feb. 5, 2020 issued in U.S. Appl. No. 15/941,388.

United States Office Action dated Jan. 6, 2020 issued in U.S. Appl. No. 15/941,181.

United States Notice of Allowance dated Jan. 6, 2020 issued in U.S. Appl. No. 15/940,373.

European Search Report dated Aug. 11, 2021 issued in Application No. 17926007.0.

* cited by examiner

DUST COLLECTOR AND CLEANER HAVING THE SAME

CROSS-REFERENCE TO RELATED APPLICATION

This application claims priority under 35 U.S.C. § 119 to Korean Application No. 10-2017-0122600, filed on Sep. 22, 2017, whose entire disclosure is hereby incorporated by reference.

BACKGROUND

1. Field

The present disclosure relates to a vacuum cleaner for sucking air and dust using a suction force, separating dust from the sucked air to collect dust, and discharging only clean air, and a dust collector provided in the vacuum cleaner.

2. Background

A vacuum cleaner refers to a device for sucking dust and air using a suction force generated by a suction motor mounted inside a cleaner body, and separating and collecting dust from the air.

Such vacuum cleaners are classified into a canister cleaner, an upright cleaner, a stick cleaner, a handy cleaner, and a robot cleaner. In case of the canister cleaner, a suction nozzle for suctioning dust is provided separately from a cleaner body, and the cleaner body and the suction nozzle are connected to each other by a connecting device. In case of the upright cleaner, the suction nozzle is rotatably connected to the cleaner body. In case of the stick cleaner and the handy cleaner, a user uses the cleaner body while holding it with his or her hand. However, in case of the stick cleaner, the suction motor is provided close to the suction nozzle (lower center), and in case of the handy vacuum cleaner, the suction motor is provided close to a grip portion (upper center). The robot cleaner performs cleaning by itself while traveling through an autonomous driving system.

There are currently disclosed many vacuum cleaners employing a multi-cyclone. Cyclone refers to a device for forming a swirling flow in a fluid and separating air and dust from each other using a centrifugal force difference resulting from a weight difference between the air and the dust. The term "multi-cyclone" refers to a structure for separating air and dust from each other using a primary cyclone, and separating air and fine dust from each other using a plurality of secondary cyclones. Here, dust and fine dust are classified by size.

For example, Korean Patent Laid-Open Publication No. 10-2015-0031304 (published on Mar. 23, 2015) discloses a cleaning device employing a multi-cyclone. The dust and fine dust which are introduced into an inside of the body along with the air are sequentially separated from the air by the primary cyclone and the secondary cyclones. A vacuum cleaner employing a cyclone has an advantage of not requiring a separate replaceable dust bag. The above reference is incorporated by reference herein where appropriate for appropriate teachings of additional or alternative details, features and/or technical background.

A cone structure is formed particularly in a body (cylinder) of a secondary cyclone in a multi-cyclone. The cone denotes a shape in which a cross-sectional area of the secondary cyclone becomes smaller toward one side. The air and fine dust introduced into the secondary cyclone are separated from each other in the secondary cyclone. The fine dust is discharged to a fine dust outlet along the cone, and the air is discharged to an air outlet formed in a direction opposite to an outlet of the fine dust.

Such a structure has a problem of causing flow loss. As a flow direction of the air changes frequently, flow loss occurs because an inlet of the secondary cyclone and the air outlet are formed on the same side with each other. The air is introduced into the inlet of the secondary cyclone, changes its direction within the secondary cyclone, and discharged again to the air outlet, thereby causing flow loss during the process.

BRIEF DESCRIPTION OF THE DRAWINGS

The embodiments will be described in detail with reference to the following drawings in which like reference numerals refer to like elements, and wherein.

DETAILED DESCRIPTION

Figure 1:
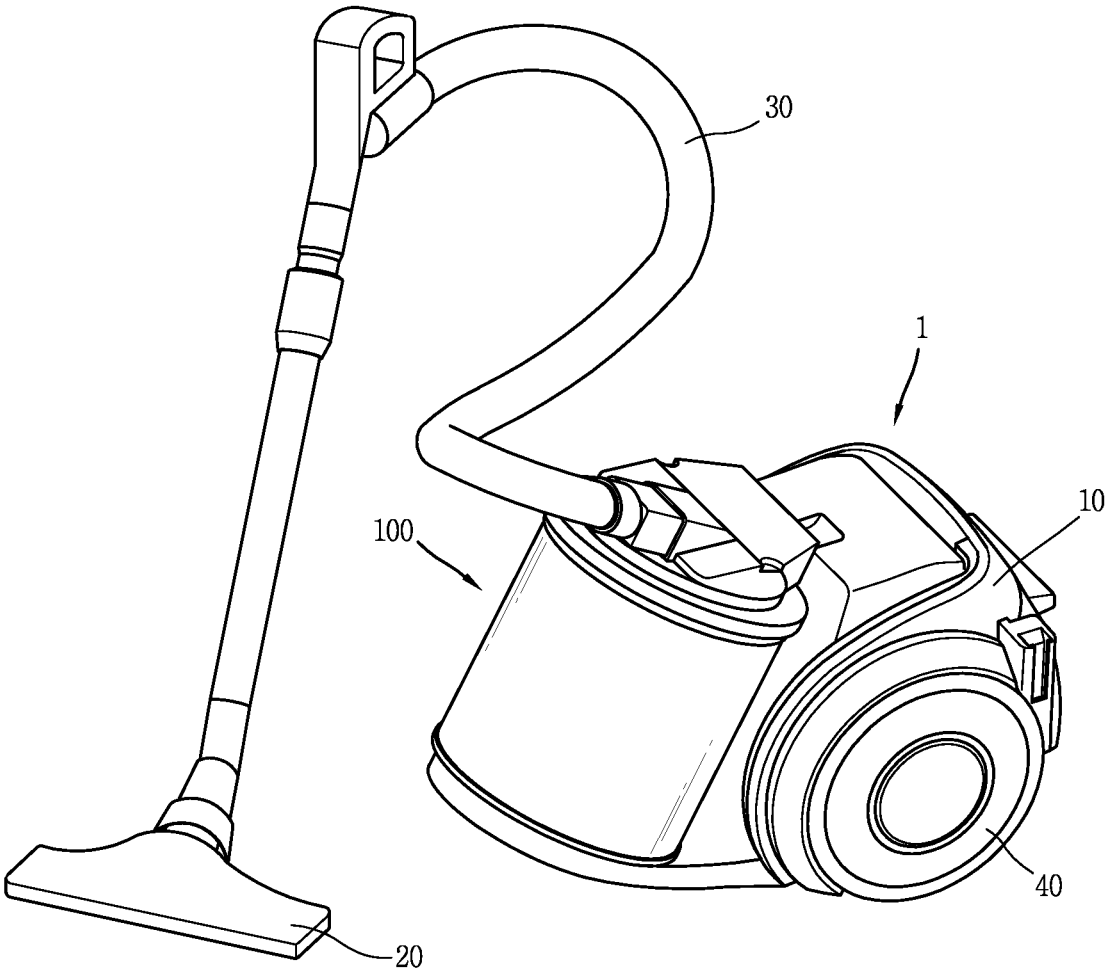
FIG. 1 is a perspective view illustrating an example of a vacuum cleaner associated with the present disclosure.

Hereinafter, a dust collector associated with the present disclosure will be described in more detail with reference to the accompanying drawings. Even in different embodiments according to the present disclosure, the same or similar reference numerals are designated to the same or similar configurations, and the description thereof will be substituted by the earlier description. Unless clearly used otherwise, expressions in the singular number used in the present disclosure may include a plural meaning.

For reference, a dust collector 100 applied to a canister-type vacuum cleaner 1 (also referred to as a bagless vacuum cleaner) is illustrated in the present drawing, but the dust collector 100 of the present disclosure is not necessarily limited to the canister-type vacuum cleaner 1. For example, the dust collector 100 of the present disclosure may also be applicable to an upright type vacuum cleaner, and the dust collector may be applicable to all types of vacuum cleaners.

FIG. 1 is a perspective view illustrating an example of a vacuum cleaner 1 associated with the present disclosure. Referring to FIG. 1, the vacuum cleaner 1 includes a cleaner body 10, a suction nozzle (or cleaner head) 20, a connecting unit (or hose) 30, a wheel unit (or wheel) 40, and a dust collector 100.

The cleaner body 10 has a suction unit (not shown) for generating a suction force. The suction unit includes a suction motor and a suction fan rotated by the suction motor to generate a suction force.

The suction nozzle 20 is configured to suck air and foreign substances adjacent to the suction nozzle 20. Here, foreign substances have a concept referring to substances other than air, and including dust, fine dust, and ultra-fine dust. Dust, fine dust, and ultra-fine dust are classified by size, and fine dust is smaller than dust and larger than ultra-fine dust.

The connecting unit 30 is connected to the suction nozzle 20 and the dust collector 100, respectively, to transfer air containing foreign matter, dust, fine dust, ultra-fine dust, and the like, sucked through the suction nozzle 20, to the dust collector 100. The connecting unit 30 may be configured in the form of a hose or pipe.

The wheel unit 40 is rotatably coupled to the cleaner body 10 to move or rotate the cleaner body 10 in every direction. For an example, the wheel unit 40 may include main wheels and an auxiliary wheel. The main wheels may be respectively provided on both sides of the cleaner body 10, and the auxiliary wheel may be configured to support the main body 10 together with the main wheels, and assist the movement of the cleaner body 10 by the main wheels.

In the present disclosure, the suction nozzle 20, the connecting unit 30, and the wheel unit 40 may be applicable to a vacuum cleaner in the related art as they are, and thus the detailed description thereof will be omitted.

The dust collector 100 is detachably coupled to the cleaner body 10. The dust collector 100 is configured to separate and collect foreign matter from air sucked through the suction nozzle 20, and discharge the filtered air.

The vacuum cleaner in the related art has a structure in which the connecting unit is connected to the suction unit formed in the cleaner body, and air suctioned through a flow guide extended from the suction unit to the dust collector is introduced back into the dust collector. The sucked air is introduced into the dust collector by a suction force of the suction unit. However, there is a problem that the suction force is reduced while passing through the flow guide of the vacuum cleaner body.

On the contrary, in the vacuum cleaner 1 of the present disclosure, the connecting unit 30 is directly connected to the dust collector 100 as illustrated in the drawings. According to such a connection structure, air sucked through the suction nozzle 20 flows directly into the dust collector 100 to enhance the suction force compared to the related art. Furthermore, there is an advantage of not requiring the formation of a flow guide inside the cleaner body 10. In addition, the secondary cyclone in which a cone structure is formed in the body (cylinder) causes flow loss. Hereinafter, the dust collector 100 having an axial inlet type swirl tube to suppress the flow loss of the secondary cyclone will be described.

Figure 2:
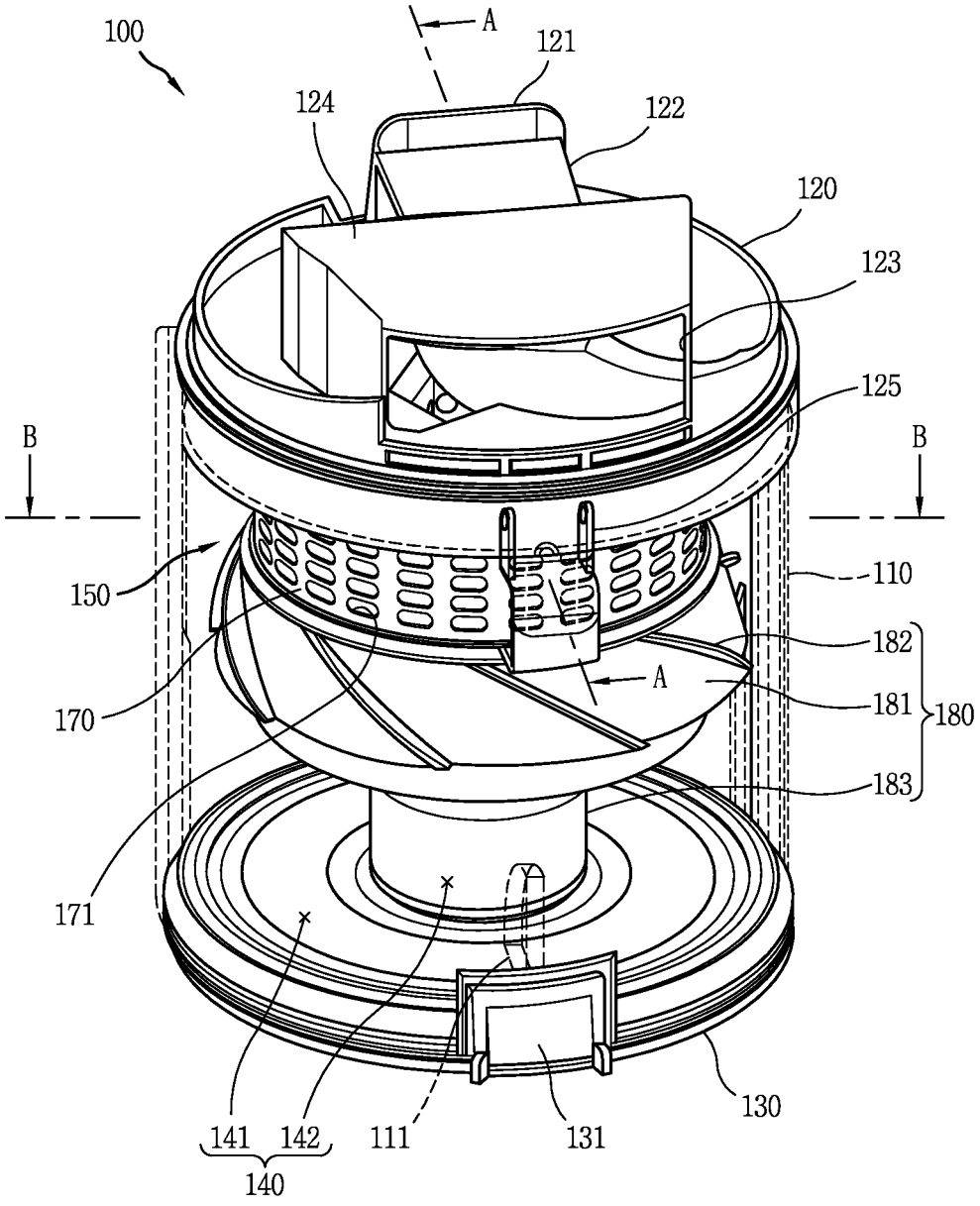
FIG. 2 is a perspective view of the dust collector illustrated in FIG. 1.
Figure 3:
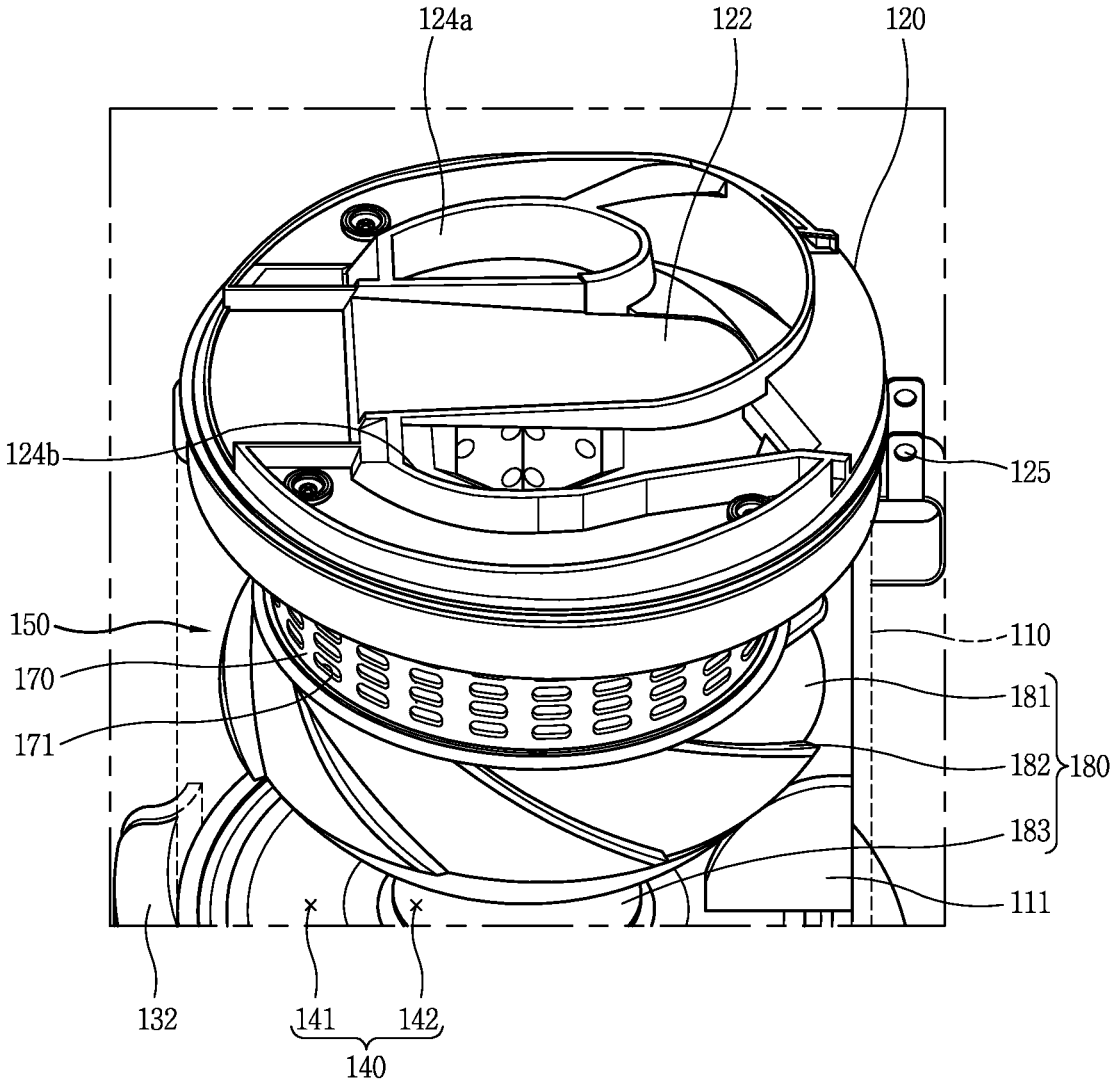
FIG. 3 is a perspective view illustrating a shape in which an upper portion of the dust collector illustrated in FIG. 2 is cut.

FIG. 2 is a perspective view of the dust collector 100 illustrated in FIG. 1, and FIG. 3 is a perspective view illustrating a shape in which an upper portion of the dust collector 100 illustrated in FIG. 2 is cut. The dust collector 100 refers to a device for separating and collecting foreign matter (dust, fine dust, ultra-fine dust, etc.) from air sucked through the suction nozzle 20. The air flows along a flow path inside the dust collector 100 by a suction force generated by the suction unit, and the foreign matter is separated from the air by the structure of the dust collector 100 during the flow.

An outer appearance of the dust collector 100 is formed by a housing 110, an upper cover 120, and a lower cover 130. The housing 110 forms a lateral appearance of the dust collector 100. The housing 110 is configured to receive the internal components of the dust collector 100, such as a cyclone (or primary cyclone) 150, a secondary cyclone that includes axial inlet type swirl tubes (or axial inlet type cyclone) 160 (see FIG. 4), and a mesh 170, which will be described below. The housing 110 may be formed in a cylindrical shape in which a top and a bottom thereof are open, but is not limited thereto.

The upper cover 120 is coupled to an upper portion of the housing 110. The upper cover 120 may be rotatably coupled to the housing 110 by a hinge 125. When it is required to open the upper cover 120 and clean an inside of the dust collector 100, the upper cover 120 may be rotated about the hinge 125 to open an upper opening of the housing 110.

An inlet 121 and an outlet 123 of the dust collector 100 may be respectively formed on the upper cover 120. Referring to FIG. 2, the inlet 121 of the dust collector 100 may be formed on one side of the upper cover 120, and the outlet 123 of the dust collector 100 may be formed on the other side of the upper cover 120.

The inlet 121 of the dust collector 100 is connected to the suction nozzle 20 by the connecting unit 30. Therefore, air and foreign matter introduced through the suction nozzle 20 flow into the dust collector 100 through the connecting unit 30. Furthermore, the outlet of the dust collector 100 is connected to an internal flow path of the cleaner body 10. Accordingly, the air separated from the foreign matter by the dust collector 100 passes through the suction nozzle 20 along the internal flow path of the cleaner body 10 and is discharged to an outside of the cleaner body 10.

The upper cover 120 may be formed with an intake guide 122 and an exhaust guide 124, respectively. The intake guide 122 is formed on a downstream side of the inlet 121 and connected to an inside of the dust collector 100. The intake guide 122 extends downward from the center of the upper cover 120 to an inner circumferential surface of the housing 110 along a spiral direction. Therefore, the air guided by the intake guide 122 flows in a tangential direction toward the inner circumferential surface of the housing 110. Accordingly, a swirling flow is naturally formed in the air flowing into an inside of the housing 110.

The exhaust guide 124 is formed around the intake guide 122. The intake guide 122 and the exhaust guide 124 are partitioned from each other by a structure of the upper cover 120. The exhaust guide 124 may have a structure in which two branched paths 124*a*, 124*b* formed at both sides of the intake guide 122 are integrated into one path, and the outlet 123 of the dust collector 100 is formed on a downstream side of the exhaust guide 124.

A first dust collection unit (or first dust collection region) 141 for collecting dust and a second dust collection unit (or second dust collection region) 142 for collecting fine dust are formed at an inner side of the housing 110. The first dust collection unit 141 and the second dust collection unit 142 are formed in a region defined by the housing 110, the lower cover 130, and the like.

The first dust collection unit 141 is formed in a ring shape at an inner side of the housing 110. The first dust collection unit 141 is formed to collect dust falling down in the cyclone 150, which will be described later. A partition plate 111 may be formed in the first dust collection unit 141. The partition plate 111 may protrude from an inner circumferential surface of the housing 110 toward a dust collection unit boundary 183.

The second dust collection unit 142 is formed in a region surrounded by the first dust collection unit 141. A cylindrically-shaped dust collection unit boundary 183 may be provided at an inner side of the housing 110 to partition the first dust collection unit 141 and the second dust collection unit 142. An outer side of the dust collecting boundary 183 corresponds to the first dust collection unit 141, and an inner side of the dust collection unit boundary 183 corresponds to the second dust collection unit 142. The second dust collection unit 142 is formed to collect fine dust falling from the axial inlet type swirl tubes 160 to be described later.

The lower cover 130 is coupled to a lower portion of the housing 110. The lower cover 130 forms the bottoms of the first dust collection unit 141 and the second dust collection unit 142. The lower cover 130 may be rotatably coupled to the housing 110 by a hinge 125. When required to open the lower cover 130 to discharge the dust collected in the first dust collection unit 141 and the fine dust collected in the second dust collection unit 142, a fastening between the upper cover 110 and the lower cover 130 is released to rotate the lower cover 130 about the hinge 125 so as to open a lower opening portion of the housing 110. The dust collected in the first dust collection unit 141 and the fine dust collected in the second dust collection unit 142 are discharged downward at a time by their respective weights.

The mesh 170 is provided at an inner side of the housing 110. The mesh 170 may be formed in a cylindrical shape having a smaller circumference than the housing 110. A plurality of holes 171 are formed on the mesh 170 and substances are filtered by the mesh 170 if they are larger in size than the holes 171 of the mesh 170.

A skirt 181 may be formed below the mesh 170. The skirt 181 may form a slope being closer to an inner surface of the housing 110 as it approaches the lower cover 130. The skirt 181 serves to prevent scattering of dust collected in the first dust collection unit 141.

Ribs 182 may protrude from an outer circumferential surface of the skirt 181 along a spiral direction. Ribs 182 induce a natural fall of the foreign matter filtered by the mesh 170 to collect the foreign matter in the first dust collection unit 141. Below the skirt 181, the dust collection unit boundary 183 described above is formed. The skirt 181, the ribs 182, and the dust collection unit boundary 183 may be formed as an integral member. The member may be referred to as an inner housing 180.

The cyclone 150 is formed at an inner side of the housing 110. Specifically, the cyclone 150 is formed by the housing 110 and the mesh 170. The cyclone 150 generates a swirling flow to separate dust from the air introduced into an inner side of the housing 110. When a suction force provided from the suction motor installed at an inner side of the cleaner body exerts an influence on an inner side of the dust collector 100, the air and the foreign matter swirl in the cyclone 150.

When a swirling flow is formed in the air and foreign matter sucked in a tangential direction of the cyclone 150 by the intake guide 122, relatively light air and fine dust flow into the mesh 170 through the hole of the mesh 170. On the contrary, relatively heavy dust flows along an inner surface of the housing 110 and falls to the first dust collection unit 141.

The axial inlet type swirl tubes 160 are provided at an inner side of a region defined by the mesh 170. Hereinafter, the structure of one axial inlet type swirl tube 160*a* will be described first, and subsequently the arrangement and operation of the axial inlet type swirl tubes 160 will be described.

Figure 4:
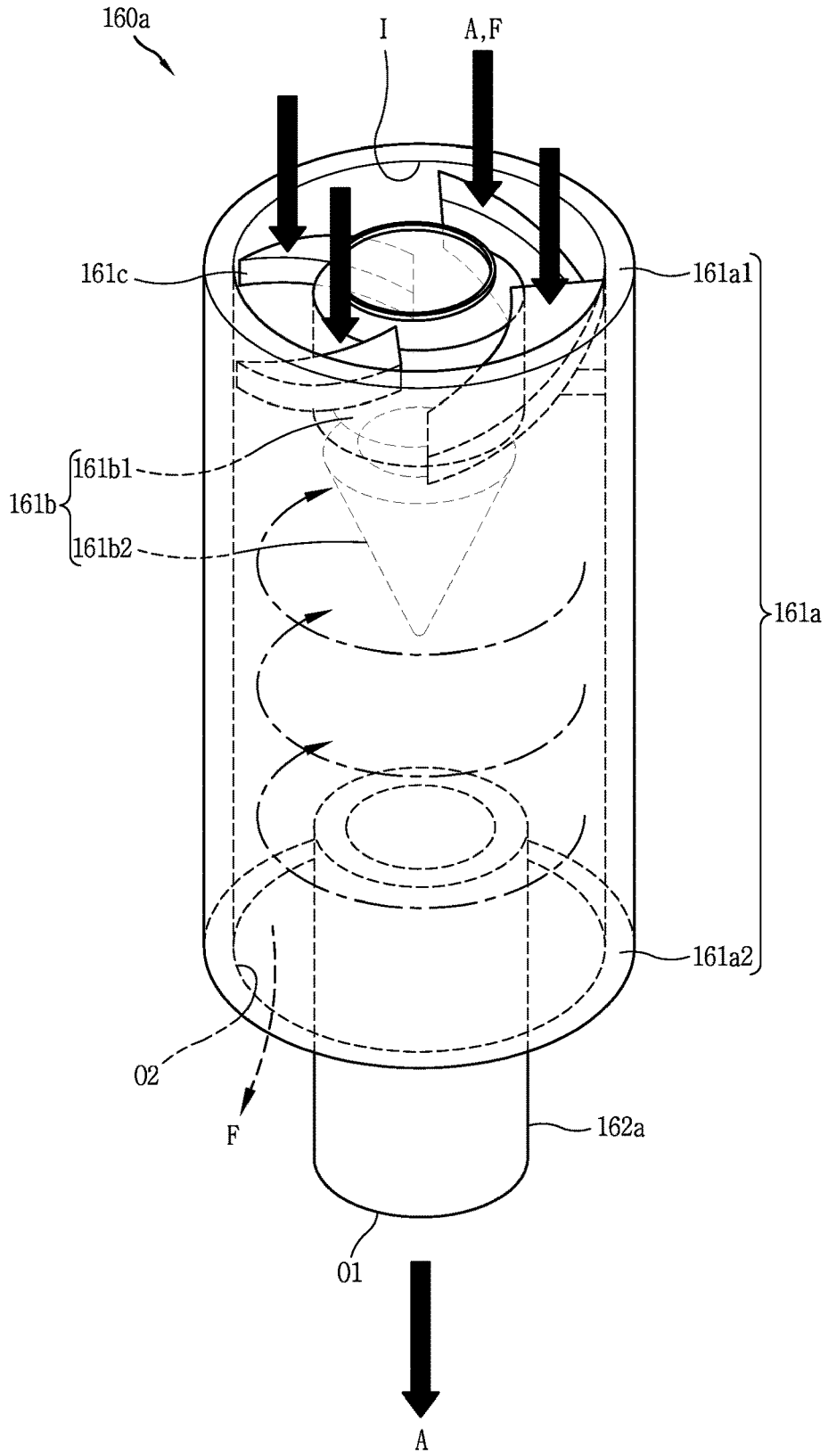
FIG. 4 is a perspective view of an axial inlet type swirl tube.

FIG. 4 is a perspective view of the axial inlet type swirl tube (or the axial inlet type cyclone) 160*a*. The axial inlet type swirl tube 160*a* is a concept included in a cyclone in a wide sense. The cyclone is divided into an axial inlet type and a tangential inlet type according to the inflow structure of air. In case of the axial inlet type cyclone, air is introduced along an axial direction of the cyclone, and in case of the tangential inlet type cyclone, air is introduced along a tangential direction of the cyclone.

The axial inlet type cyclone is divided into a cone type and a tube type according to the structure. The cone type has a structure in which the inner diameter gradually decreases in size, while the tube type has a structure in which the inner diameter is constant in size.

The cone type may have only a reverse flow structure, while the tube type may selectively have either one of a reverse direction and a forward flow structure. The reverse flow structure refers to a structure in which an inlet of air and an outlet of air are open in the same direction in such a manner that air introduced into the inlet of air reverses the flow direction and is discharged to the outlet of air. In contrast, the forward flow structure refers to a structure in which the inlet of air and the outlet of air are open in directions opposite to each other, and air introduced into the inlet of air is discharged to the outlet of air while maintaining the flow direction.

The axial inlet type swirl tube 160*a* of the present disclosure corresponds to an axial inlet type and a tube type, and has a forward flow structure. The axial inlet type swirl tube 160*a* is supplied with air and fine dust that have passed through the cyclone 150 and the mesh 170. Furthermore, the axial inlet type swirl tube causes a swirling flow to separate the fine dust from the air.

The axial inlet type swirl tube 160*a* receives the air (A) and the fine dust (F) along an axial direction. The axial direction refers to a direction extending toward the inlet (I) and the outlets (O1, O2) of the axial inlet type swirl tube 160*a*. When the air and the fine dust are supplied along an axial direction, the flow may be uniformly and symmetrically formed at 360° (degrees), thereby preventing the occurrence of a phenomenon of concentration of the flow in one region.

The axial inlet type swirl tube 160*a* includes a body (or cylinder) 161*a*, a vortex finder 161*b*, a vane 161*c*, and an outlet partition portion (or outlet partition) 162*a*. The body 161*a* forms an appearance of the axial inlet type swirl tube 160*a* and forms a boundary between an inner side and an outer side of the axial inlet type swirl tube 160*a*. The body 161*a* is formed in a hollow cylindrical shape, and an inner diameter of the body 161*a* is constant. One side (upper side) 161*a*1 and the other side (lower side) 161*a*2 of the body 161*a* are open. Referring to FIG. 4, the open upper portion 161*a*1 corresponds to the inlet (I) of the body 161*a* and the open lower portion 161*a*2 corresponds to the outlets (O1, O2) of the body 161*a*. Therefore, the inlet (I) and the outlets (O1, O2) of the body 161*a* are open toward directions opposite to each other.

A vortex finder 161*b* is provided on an inlet side 161*a*1 of the body 161*a*. The vortex finder 161*b* includes a first portion 161*b*1 and a second portion 161*b*2. The first portion (or first surface) 161*b*1 is formed in a cylindrical shape. Furthermore, the second portion (or second surface) 161*b*2 protrudes from the first portion 161*b*1 toward the outlets (O1, O2) of the body 161*a*, and has a cone shape.

The second portion 161*b*2 of the axial inlet type swirl tube 160*a* is clogged (e.g., connected to the first portion 161*b*1). Therefore, air is not discharged to an inside of the vortex finder 161*b*. Since the air is not discharged to an inside of the vortex finder 161*b*, the air does not change the flow direction inside the body 161*a*.

The vane 161*c* is formed between an outer circumferential surface of the first portion 161*b*1 and an inner circumferential surface of the body 161*a*. There may be provided with a plurality of vanes 161*c*, and the plurality of vanes 161*c* extend in a spiral direction. The vortex finder 161*b* and the vane 161*c* form a swirling flow of air and fine dust between an outer circumferential surface of the vortex finder 161*b* and an inner circumferential surface of the body 161*a*.

The outlets (O1, O2) of the axial inlet type swirl tube 160*a* include an air outlet (O1) and a fine dust outlet (O2). The air outlet (O1) and the fine dust outlet (O2) are open toward the same direction (the outlet side 161*a*2 of the body 161*a*). The outlet partition portion 162*a* is provided on the outlet side 161*a*2 of the body 161*a* and formed to partition the air outlet (O1) and the fine dust outlet (O2).

Referring to FIG. 4, the fine dust outlet (O2) is formed in a ring shape around the air outlet (O1). An inner region defined by the outlet partition portion 162*a* corresponds to the air outlet (O1). Furthermore, a region between an outer circumferential surface of the outlet partition portion 162*a* and an inner circumferential surface of the body 161*a* corresponds to the fine dust outlet (O2). The outlet partition portion 162*a* is formed in a cylindrical shape and defines the air outlet (O1) and the fine dust outlet (O2).

Referring to FIG. 4, the body 161*a* and the vortex finder 161*b* may be connected to each other by a vane 161*c*. Therefore, the body 161*a*, the vortex finder 161*b*, and the vane 161*c* may be formed by one member, and this one member may be referred to as a first member 161. On the other hand, the outlet partitioning portion 162*a* is spaced apart from the body 161*a*. Therefore, the outlet partition portion 162*a* is formed by a separate member, and the separate member may be referred to as a second member 162. The axial inlet type swirl tubes 160 are formed by an engagement of the first member 161 and the second member 162.

Figure 5:
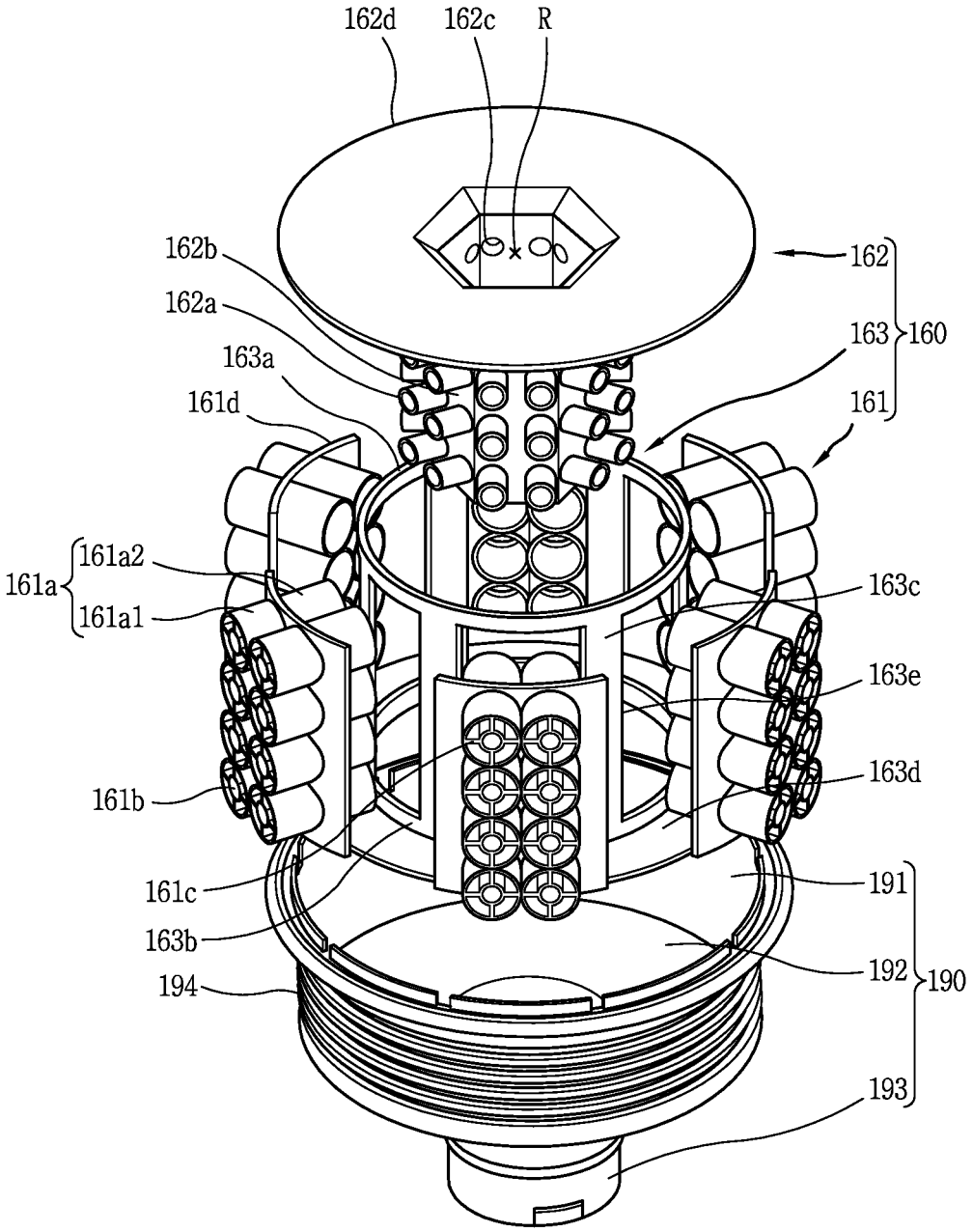
FIG. 5 is an exploded perspective view illustrating an internal structure of the dust collector illustrated in FIG. 2.

Hereinafter, a coupling structure of the first member (or inlet member) 161 and the second member (or outlet member) 162 will be described. FIG. 5 is an exploded perspective view illustrating an internal structure of the dust collector 100 illustrated in FIG. 2.

The dust collector 100 includes a plurality of axial inlet type swirl tubes 160. The axial inlet type swirl tubes 160 may be formed by an engagement of the first member 161 and the second member 162. There may be provided with a plurality of first members 161, and there may be provided with a single second member 162. The dust collector 100 includes a frame 163 for fixing the first member 161 and the second member 162.

The frame 163 includes an upper rim 163*a*, a lower rim 163*b*, a plurality of pillars 163*c*, and a second dust collection unit top cover 163*d*. The upper rim 163*a* and the lower rim 163*b* have a circular or polygonal shape, respectively. The upper rim 163*a* and the lower rim 163*b* may have the same shape. Furthermore, the upper rim 163*a* and the lower rim 163*b* are provided apart from each other along a height direction of the dust collector 100.

The pillars 163*c* extend along a height direction of the dust collector 100 to connect the upper rim 163*a* and the lower rim 163*b* to each other. The height direction of the dust collector 100 refers to a vertical direction toward the upper cover 120 and the lower cover 130 in FIG. 5.

The pillars 163*c* are provided apart from each other to form at least one hole 163*e* on a lateral surface of the frame 163. The frame 163 formed by the upper rim 163*a*, the lower rim 163*b* and the pillars 163*c* has a structure formed with at least one hole 163*e* on cylindrical or polygonal upper and lower surfaces, and a lateral surface, respectively.

The second dust collection unit top cover 163*d* is extended toward a circumferential direction at the lower rim 163*b*, and formed in a ring shape. When the frame 163 is inserted into a support member 190, the second dust collection unit top cover 163*d* comes into contact with the support member 190 along an inner circumferential surface of the support member 190. An inlet side of the axial inlet type swirl tubes 160 and the second dust collection unit 142 are separated from each other by the second dust collection section top cover 163*d*.

The first member 161 includes a curved or planar body base 161*d*. The body 161*a* of the axial inlet type swirl tube protrudes to both sides of the body base 161*d*. The inlet side 161*a*1 of the body 161*a* protrudes from one side of the body base 161*d* and the outlet side 161*a*2 of the body 161*a* protrudes from the other side of the body base 161*d*. The inlet side 161*a*1 and the outlet side 161*a*2 of the body 161*a* are divided based on the body base 161*d*.

If the upper and lower rims 163*a*, 163*b* of the frame 163 are circular, then the body base 161*d* is formed as a curved surface having the same curvature as the upper rim 163*a* or the lower rim 163*b*. On the other hand, if the upper and lower rims 163*a*, 163*b* of the frame 163 are polygonal, the body base 161*d* is formed as a flat surface. Referring to FIG. 5, the upper rim 163*a* and the lower rim 163*b* are formed in a circular shape, and the body base 161*d* is formed in a curved surface.

One body base 161*d* and a plurality of bodies 161*a* may be formed for each first member 161. Furthermore, a plurality of bodies 161*a* may be stacked in multiple stages for each first member 161, and a plurality of bodies 161*a* may be formed for each stage. In FIG. 5, the bodies 161*a* are stacked in four stages for each first member 161, and two bodies 161*a* are formed for each stage. The vortex finder 161*b* and the vane 161*c* are formed on an inner side of each body 161*a*.

The first member 161 is inserted in a lateral direction of the frame 163 through the hole 163*e* formed between the pillars 163*c* and fixed to the frame 163. A number of the holes 163*e* formed on a lateral surface of the frame 163 is equal to a number of the first members 161. The axial inlet type swirl tubes 160 are divided into a plurality of groups according to a direction in which the inlet (I) faces, and a number of the first members 161 is equal to a number of the groups. For example, referring to FIG. 5, the axial inlet type swirl tubes 160 are divided into six groups, and six first members 161 are provided.

The first members 161 of each group are inserted into different holes 163*e* of the frame 163 in different directions. Referring to FIG. 5, when the frame 163 is seen from the top, the first members of each group are inserted into different holes 163*e* of the frame 163 in the 12 o'clock direction, 2 o'clock direction, 4 o'clock direction, 6 o'clock direction, 8 o'clock direction, and 10 o'clock direction of the frame 161. Specifically, an outlet side 161*b*2 of each body 161*a* is inserted into the hole, and an inlet side of the body 161*a* is exposed to an outside of the frame 163.

When the first member 161 is engaged with the frame 163, the body base 161*d* blocks a hole formed on a lateral surface of the frame 163. Since the body base 161*d* has a shape corresponding to a lateral surface of the frame 163, the hole formed on the lateral surface of the frame 163 is sealed by the body base 161*d*.

The second member 162 includes an outlet base (or outlet base surface) 162*b*, an air vent hole 162*c*, an outlet partition portion (or outlet partitions) 162*a*, and an upper block portion (or upper block surface) 162*d*.

The outlet base 162*b* has a curved surface or a flat surface. The outlet base 162*b* corresponds to a lateral surface of the cylindrical or polygonal pillar. Referring to FIG. 5, it is shown a configuration in which the outlet base 162*b* corresponds to a lateral surface of a hexagonal pillar 163*c*. The outlet base 162*b* of the second member 162 is provided in the same number as that of a group of axial inlet type swirl tubes 160. For example, FIG. 5 illustrates a configuration in which six outlet bases 162*b* are provided so as to correspond to six groups of axial inlet type swirl tubes 160.

In a region surrounded by a plurality of outlet bases 162*b*, a rising flow path (R) of air discharged from the axial inlet type swirl tubes 160 is formed. The air discharged from the axial inlet type swirl tubes 160 is collected into the rising flow path (R) at the center of the second member 162. The rising flow path (R) leads to an outlet of the dust collector 100 formed on an upper side of the housing 110. Therefore, the air is moved upward by a suction force of the suction motor, and discharged to the outlet 123 of the dust collector 100 along the exhaust guide 124.

The air outlet holes 162*c* are formed in each outlet base 162*b*. The air vent holes 162*c* are formed in the same number as that of the axial inlet type swirl tubes 160. Furthermore, the air vent holes 162*c* have the same arrangement as that of the bodies 161*a*. For example, the air vent holes 162*c* may be stacked in multiple stages, and a plurality of air vent holes 162*c* may be formed in each stage.

The outlet partition portion 162*a* protrudes from the periphery of each air vent hole 162*c* toward an inside of the body 161*a*. Since the air vent hole 162*c* is formed in the outlet base 162*b*, it may be understood that the outlet partition portion 162*a* protrudes from the outlet base 162*b*. The outlet compartments 162*a* have the same arrangement as that of the bodies 161*a* similarly to the air vent holes 162*c*.

The second member 162 is inserted into the frame 163 from an upper side of the frame 163 through a hole defined by the upper rim 163*a*, and is mounted on the upper rim 163*a*. The upper block portion 162*d* of the second member 162 is formed at an upper end of the outlet base 162*b* to be mountable on the upper rim 163*a*. The upper block portion 162*d* is formed in a ring shape in a direction extending from the periphery of the rising flow path (R). The upper block portion 162*d* prevents the mixing of fine dust and air discharged from the axial inlet type swirl tubes 160.

When the second member 162 and the first member 161 are sequentially coupled to the frame 163, the axial inlet type swirl tubes 160 are formed. The axial inlet type swirl tubes 160 may be supported by a support member 190. The support member 190 may be formed to receive a lower end of the axial inlet type swirl tubes 160.

The support member 190 includes a receiving portion (or receiving surface) 191, an inclined portion (an inclined surface) 192, and a dust collecting guide 193. A sealing member (or seal) 194 may be coupled to an outer circumferential surface of the support member 190. Each configuration will be described later with reference to FIG. 6.

Figure 6:
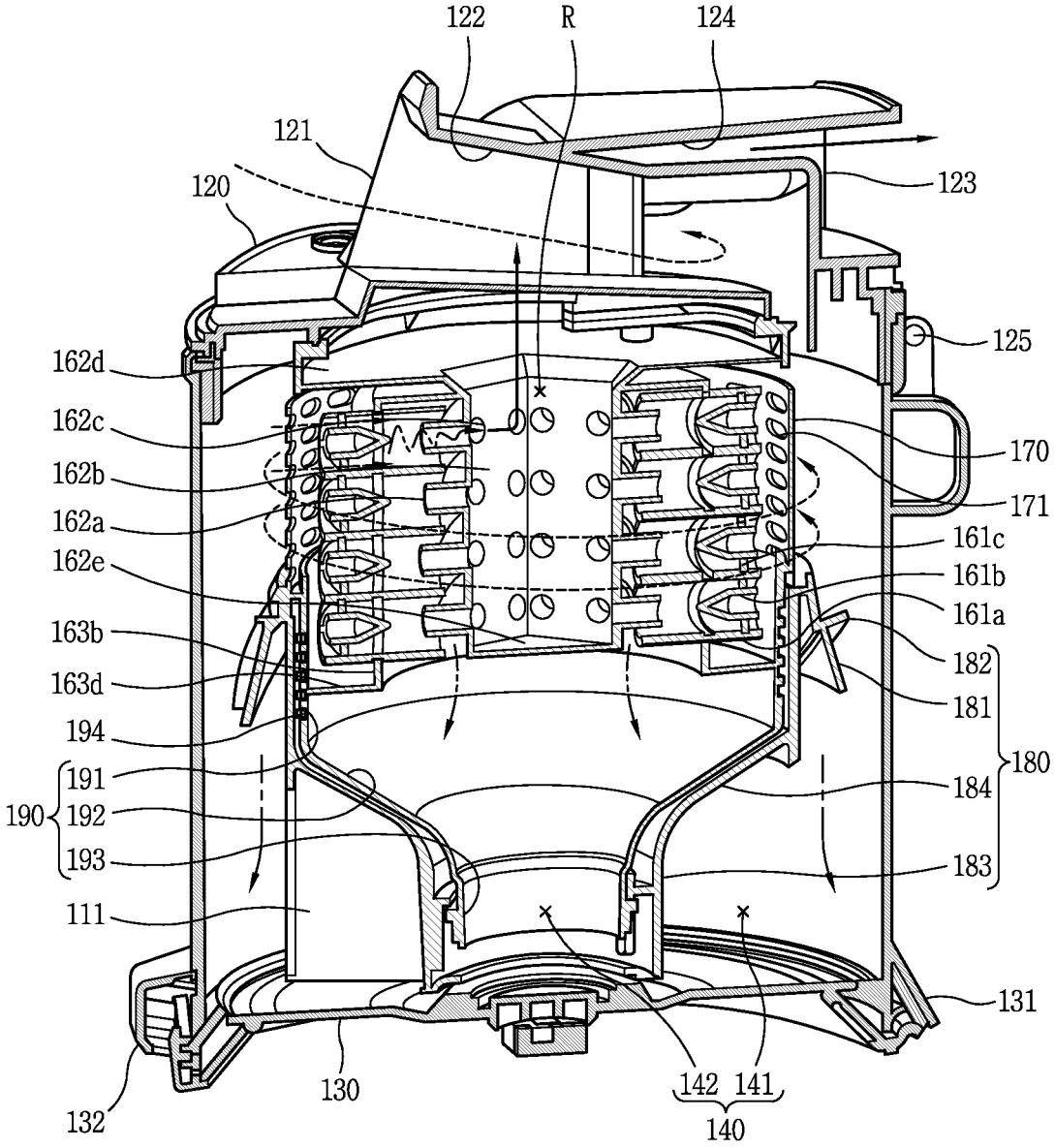
FIG. 6 is a cross-sectional view in which the dust collector illustrated in FIG. 2 is cut along line A-A and seen from one side.

FIG. 6 is a cross-sectional view in which the dust collector 100 illustrated in FIG. 2 is cut along line A-A and seen from one side. When a plurality of first members 161 are inserted laterally through holes 163*e* formed on a lateral surface of the frame 163 in a state where the second member 162 is inserted into the frame 163 from an upper side of the frame 163 and mounted on the upper rim 163*a*, at least part of each of the outlet partition portion 162*a* protruding from the outlet base 162*b* is inserted into an outlet side 161*a*2 of each body 161*a*. As a result, the axial inlet type swirl tubes 160 are formed. The axial inlet type swirl tubes 160 are stacked in multiple stages.

The second member 162 further includes a lower block portion (or lower block surface) 162*e*. When the outlet base 162*b* of the second member 162 corresponds to a lateral surface of a cylindrical or polygonal pillar, the lower block portion 162*e* corresponds to a bottom side of the cylindrical or polygonal pillar. An upper surface of the cylindrical or polygonal pillar is open to discharge air through the rising flow path (R).

The lower block portion 162*e* blocks a suction force generated by the suction motor from reaching the fine dust collected by the second dust collection unit 142. Accordingly, the lower block portion 162*e* prevents the fine dust collected in the second dust collection portion 142 from being scattered to the rising flow path (R) of the air.

The upper block portion 162*d* extends toward a circumferential direction from an upper end of the outlet base 162*b*. Since the fine dust outlet (O2) of each axial inlet type swirl tube is formed around the air outlet (O1), the fine dust is discharged through the periphery of the air outlet (O1). However, a remaining region excluding the fine dust falling flow paths D1, D2 which will be described later is blocked by the outlet base 162*b* and the upper block portion 162*d*. Accordingly, the upper block portion 162*d* prevents the mixing of fine dust and air discharged from the axial inlet type swirl tubes 160.

Referring to FIG. 6, a mesh 170 is provided in an inner region of the housing 110. The mesh 170 surrounds an outside of the axial inlet type swirl tubes 160 to form a boundary between the cyclone 150 and the axial inlet type swirl tubes 160. The axial inlet type swirl tubes 160 are provided in an inner region of the mesh 170. Furthermore, a rising flow path (R) of air is formed in a region surrounded by the axial inlet type swirl tubes 160.

A pre-filter (not shown) may be provided at an upper end of the upper block portion 162*d*. The pre-filter may be formed to filter ultra-fine dust from the air discharged through the rising flow path (R). The pre-filter is referred to as a pre-filter because it is provided at an upstream side of the suction motor on the basis of the flow of air.

Hereinafter, the process of separating air and foreign matter will be described. The air and the foreign matter are sequentially passed through the suction nozzle 20 and the connecting unit 30 by a suction force generated by the suction motor of the vacuum cleaner 1, and introduced into the dust collector 100 through the inlet of the dust collector 100.

The air introduced into the dust collector 100 swirls inside the housing 110. A centrifugal force of dust that is heavier than air is larger than that of the air. Accordingly, the dust swirls along an inner circumferential surface of the housing 110 and then the dust falls and is collected in the first dust collection unit 141.

The air flows through the mesh 170 into the axial inlet type swirl tubes 160 and swirls inside the body 161*a* by the guide vanes 161*c*. A centrifugal force of fine dust that is heavier than air is larger than that of the air. Therefore, the fine dust swirls along an inner circumferential surface of the body 161*a*, and then is discharged to the fine dust outlet (O2), and falls along the fine dust falling flow paths D1, D2 (see FIG. 7), and is collected in the second dust collection portion 142. The air is discharged to the air outlet (O1) and then discharged to an outside of the dust collector 100 while sequentially passing through the rising flow path (R), the exhaust guide 124 and the outlet 123 of the dust collector 100.

The support member 190 includes a receiving portion 191, an inclined portion 192, and a dust collecting guide 193. The receiving portion 191 corresponds to an uppermost portion of the support member 190 and the dust collecting guide 193 corresponds to the lowermost portion of the support member 190. The inclined portion 192 is formed between the receiving portion 191 and the dust collecting guide 193. The receiving portion 191 and the dust collecting guide 193 are formed in a cylindrical shape, and the receiving portion 191 has a larger cross-sectional area than the dust collecting guide 193.

The receiving portion 191 is formed so as to surround a lower end of the axial inlet type swirl tubes 160. However, an inner circumferential surface of the receiving portion 191 must be spaced from the inlet (I) of the axial inlet type swirl tubes 160 so as not to block a flow path of the air and the fine dust flowing into the axial inlet type swirl tubes 160.

The inclined portion 192 is formed in an inclined manner such that the cross-sectional area gradually decreases toward the bottom of the support member 190. Accordingly, the fine dust discharged from the axial inlet type swirl tubes 160 flows down smoothly along the inclined portion 192.

The dust collecting guide 193 protrudes from the inclined portion 192 toward the lower cover 130, and is inserted into the dust collection unit boundary 183. Accordingly, the fine dust discharged from the axial inlet type swirl tubes 160 is guided to the second dust collection unit 142 by the dust collecting guide 193.

The mesh 170 may be mounted at an upper end of the inner housing 180. The inner housing 180 is formed to surround the support member 190. The foregoing skirt 181 is formed at an upper portion of the inner housing 180. Furthermore, the dust collecting boundary 183 is formed at a lower portion of the inner housing 180. The dust collection unit boundary 183 is in close contact with the lower cover 130 to partition the dust collection unit (or dust collection chamber) 140 into a first dust collection unit (or first dust collection chamber) 141 and a second dust collection unit (or second dust collection chamber) 142. A mounting portion 184 for mounting the support member 190 is formed between the skirt 181 and the dust collection unit boundary 183. The mounting portion 184 may be formed to be inclined in the same manner as the inclined portion 192 of the support member 190.

A ring-shaped sealing member 194 may be provided between an inner circumferential surface of the inner housing 180 and an outer circumferential surface of the support member 190. A plurality of sealing members 194 may be provided. When the support member 190 is inserted into the inner housing 180, the sealing member 194 seals between the inner housing 180 and the support member 190. Accordingly, it may be possible to prevent the leakage of fine dust collected in the second dust collection unit 142.

Figure 7:
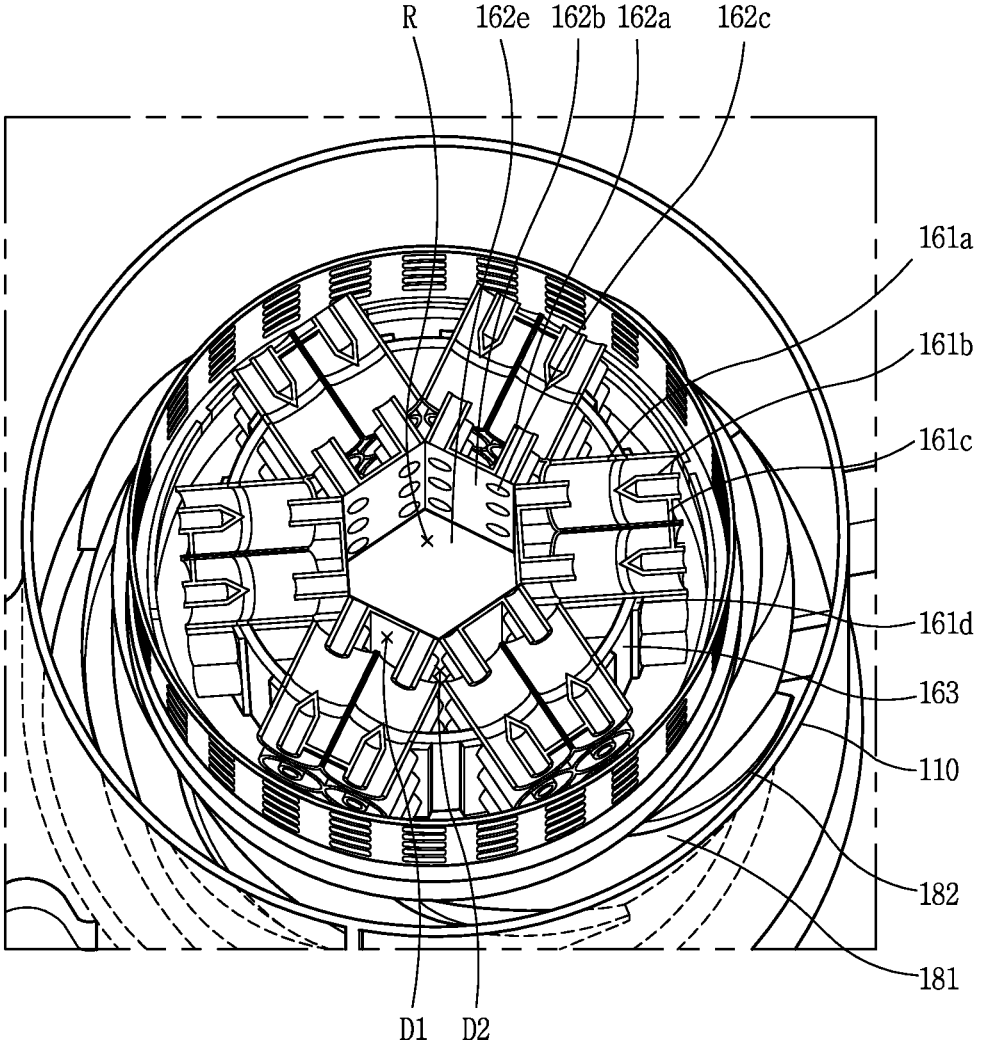
FIG. 7 is a cross-sectional view in which the dust collector illustrated in FIG. 2 is cut along line B-B and seen from the top.

FIG. 7 is a cross-sectional view in which the dust collector 100 illustrated in FIG. 2 is cut along line B-B and seen from the top. The axial inlet type swirl tubes 160 are stacked in multiple stages. Furthermore, the axial inlet type swirl tubes 160 in each stage are arranged radially. Being arranged radially denotes that the inlet (I) of each axial inlet type swirl tube is directed to an inner side of the mesh 170 and the outlet is arranged to face the center of a region defined by the housing 110. The outlet of the axial inlet type swirl tubes 160 is arranged to face the rising flow path (R) because the rising flow path (R) of air is formed at the center of a region defined by the housing 110.

The axial inlet type swirl tubes 160 are divided into a plurality of groups according to a direction in which the inlet (I) faces. In FIG. 7, since the directions of the inlet (I) of the axial inlet type swirl tubes 160 are divided into six, the axial inlet type swirl tubes 160 are divided into six groups. However, the present disclosure is not limited thereto, and may be divided into 8, 10, or 12 groups depending on a direction in which the inlet of the axial inlet type swirl tubes 160 faces. In this case, the outlet base 162*b* forms the sides of an octagonal pillar, a decagonal pillar, and a dodecagonal pillar, respectively, and octagonal, decagonal, and dodecagonal holes are formed on a lateral surface of the frame 163. In addition, eight, ten, and twelve first members 161 are provided.

The outlet of the axial inlet type swirl tube belonging to any one group may be provided to face the outlet of the axial inlet type swirl tube belonging to another one group. Here, the outlet means the air vent hole 162*c*. It is because the axial inlet type swirl tubes 160 are radially arranged.

An arrangement angle formed by adjacent two groups based on the center of a region defined by the housing 110 is constant. For example, when the axial inlet type swirl tubes 160 are divided into n groups, the arrangement angle is 360/n° (degrees). In FIG. 7, the arrangement angle formed by the axial inlet type swirl tubes 160 is constant at 60° (degrees).

An end portion of the outlet side 161*a*2 of the body 161*a* and the outlet base 162*b* are spaced from each other to form fine dust falling flow paths D1, D2 communicating with the second dust collection unit 142 therebetween. Since each end of the axial inlet type swirl tubes 160 has the same structure, the fine dust falling flow paths D1, D2 extend downward toward the second dust collection unit 142.

The end portions of the outlet sides 161*a*2 of two bodies 161*a* provided adjacent to each other are arranged to be in contact with each other. Not only two bodies 161*a* belonging to the same group but also bodies 161*a* belonging to two groups adjacent to each other are arranged to be in contact with each other. An end portion of the respective outlet sides 161*a*2 of the two bodies 161*a* in contact with each other and the outlet base 162*b* are spaced from each other to form fine dust falling flow paths D1, D2 therebetween. Accordingly, the air outlet (O1) and the fine dust falling flow paths D1, D2 are alternately formed along the outlet base 162*b*.

As a number of the swirl inlet type swirl tubes 160 increases, the separation performance for separating fine dust from air is improved, and therefore, it is preferable that the number of the axial inlet type swirl tubes 160 is as large as possible. However, since the number of the axial inlet type swirl tubes 160 cannot be increased indefinitely within a limited space, the number of the axial inlet type swirl tubes 160 must be maximized through an efficient arrangement thereof. As illustrated in FIG. 7, when the axial inlet type swirl tubes 160 are stacked in multiple stages, the number of the axial inlet type swirl tubes 160 may be increased.

Furthermore, in order to suppress the flow loss (pressure loss) of air, a flow direction change of the air must be minimized. The pressure loss of the air has an effect on the performance of the dust collector 100. As illustrated in FIG. 7, when the axial inlet type swirl tubes 160 are arranged at the same height as the mesh 170 and radially arranged so that the inlet of each axial inlet type swirl tube faces the mesh 170, air that has passed through the cyclone 150 and the mesh 170 is directly introduced into the axial inlet type swirl tube without changing the flow direction.

In addition, since the axial inlet type swirl tube has the inlet and the outlet formed opposite to each other, unlike the cyclone 150, air introduced through the inlet of the axial inlet type swirl tube is directly discharged to the outlet without changing the flow direction. Therefore, the pressure loss of the air may be suppressed through the structure and arrangement of the axial inlet type swirl tube.

The configurations and methods according to the above-described embodiments will not be limited to the foregoing dust collector and cleaner, and all or part of each embodiment may be selectively combined and configured to make various modifications thereto.

According to the present disclosure having the foregoing configuration, the axial inlet type swirl tube has a forward direct inlet structure and a forward direct outlet structure. For example, since the inlet of the axial inlet type cyclone is provided to face the mesh, air passing through the mesh immediately flows into the inlet of the axial inlet type swirl tube without changing the flow direction. Furthermore, since the inlet and the outlet of the axial inlet type swirl tube are formed on opposite sides to each other, air introduced through the inlet is discharged through the outlet without changing the flow direction.

The flow direction of the air does not change during the process of being introduced into and discharged from the axial inlet type swirl tube, and thus when using the structure and arrangement of the axial inlet type swirl tube proposed in the present disclosure, it may be possible to suppress the flow loss (pressure loss) of the air and improve the performance of the dust collector.

Furthermore, according to the present disclosure, since the axial inlet type swirl tubes are stacked in multiple stages, the number of the axial inlet type swirl tubes may be increased within a limited space. In particular, the axial inlet type swirl tube is advantageous for downsizing compared to the cyclone. Accordingly, an increase in the number of the multi-stage arrangements of the axial inlet type swirl tubes improves the separation performance of separating fine dust from air.

In addition, according to the present disclosure, the expansion of a space occupied by the axial inlet type swirl tubes may be suppressed through an optimal arrangement of the axial inlet type swirl tubes, thereby increasing the capacity of the dust collection unit for collecting dust.

An aspect of the present disclosure provides a cleaner having a structure capable of suppressing the flow loss of air by using a high-efficiency axial inlet type swirl tube. Another aspect of the present disclosure provides a structure capable of maximizing an efficiency of the axial inlet type swirl tube through an optimal arrangement of the axial inlet type swirl tube. In particular, the present disclosure is to present a structure of optimizing an arrangement and the like capable of improving the flow direction of air introduced into or discharged from the axial inlet type swirl tube, and increasing a number of the axial inlet type swirl tubes.

In order to accomplish the foregoing aspect of the present disclosure, a dust collector according to an embodiment of the present disclosure may include an axial inlet type swirl tube provided at a downstream side of a cyclone. The axial inlet type swirl tubes are stacked in multiple stages, and the axial inlet type swirl tubes in each stage are arranged radially.

The dust collector may include a housing configured to form an outer appearance of the dust collector; a cyclone formed inside the housing to cause a swirling flow to separate dust from air introduced into the housing; and a mesh configured to surround an outside of the axial inlet type swirl tubes to form a boundary between the cyclone and the axial inlet type swirl tubes.

The axial inlet type swirl tubes may receive air and fine dust that have passed through the cyclone, and cause a swirling flow to separate the fine dust from the air. The axial inlet type swirl tubes in each stage may be arranged such that the inlet faces an inner surface of the mesh and the outlet faces the center of a region defined by the housing.

An outlet of each of the axial inlet type swirl tubes may include an air outlet and a fine dust outlet that are open toward the same direction, and the inlet may be open toward a direction opposite to the air outlet and the fine dust outlet. The fine dust outlet may be formed in a ring shape around the air outlet.

Each of the axial inlet type swirl tubes may include a cylindrical body; a vortex finder provided on an inlet side of the body, and provided with a cylindrically shaped first portion and a cone shaped second portion protruded from the first portion toward an outlet side of the body; a vane formed between an outer circumferential surface of the first portion and an inner circumferential surface of the body, and extended in a spiral direction; and an outlet partition portion provided at an outlet side of the body, and formed in a cylindrical shape to partition the air outlet and the fine dust outlet formed around the air outlet.

The axial inlet type swirl tubes may be formed by a coupling between a first member and a second member, and the first member may form the body, the vortex finder and the vane of each axial inlet type swirl tube, and the second member may form the outlet partition portion of each axial inlet type swirl tube, and at least part of the outlet partition portion may be inserted into an outlet side of the body.

The first member further may include a curved or planar body base, and the body may be protruded to both sides of the body base, and the second member may further include an outlet base having a curved or planar shape, and the outlet base may be formed with a number of air vent holes corresponding to the axial inlet type swirl tubes, and the outlet partition portion may be protruded from a periphery of the air vent hole toward an inside of the body.

The outlet base may correspond to a lateral surface of a cylindrical or polygonal pillar, and a rising flow path of air discharged from the axial inlet type swirl tubes may be formed in an region surrounded by the outlet base, and the rising flow path may communicate with an outlet of the dust collector formed on an upper side of the housing.

The mesh may be provided in an inner region of the housing, and the axial inlet type swirl tubes may be provided in an inner region of the mesh, and the rising flow path may be formed in a region surrounded by the axial inlet type swirl tubes.

The dust collector may further include a first dust collection unit formed in a ring shape inside the housing, and formed to collect dust falling from the cyclone; and a second dust collection unit formed in a region surrounded by the first dust collection unit, and formed to collect fine dust falling from the axial inlet type swirl tubes, wherein the second member further includes a lower block portion for partitioning the second dust collection unit and the rising flow path to prevent fine dust collected in the second dust collection unit from being scattered to the rising flow path, and the lower block portion corresponds to a bottom side of the cylindrical or polygonal pillar.

The dust collector may further include a frame for fixing the first member and the second member, and the frame may include an upper rim having a circular or polygonal shape; a lower rim having the same shape as that of the upper frame, and spaced apart from the upper rim; and pillars extended along a height direction of the dust collector to connect the upper rim and the lower rim to each other, and spaced apart from each other to form a hole on a lateral surface of the frame.

The frame further may include a ring shaped second dust collection unit top cover extended in a circumferential direction from the lower rim. The first member may be inserted in a lateral direction of the frame through a hole formed between the pillars and fixed to the frame. The first member may further include a planar or curved body base that fixes the body, and the body base may be provided to block the hole.

The axial inlet type swirl tubes may be divided into a plurality of groups according to a direction in which the inlet faces, and the first member may be provided by a number of the groups, and the first member of each group may be inserted into the hole of the frame in a different direction.

The second member may be inserted from an upper side of the frame through a hole defined by the upper rim, and mounted on the upper rim, and the second member may further include a planar or curved outlet base that fixes the outlet partition portion; and an upper block portion formed at an upper end of the outlet base to be mountable on the upper rim to prevent the mixing of air and fine dust discharged from the axial inlet type swirl tubes.

The dust collector may further include a first dust collection unit formed in a ring shape inside the housing and formed to collect dust falling from the cyclone; and a second dust collection unit formed in a region surrounded by the first dust collection unit, and formed to collect fine dust falling from the axial inlet type swirl tubes, and an end portion of the outlet side of the body and the outlet base are spaced apart from each other to form a fine dust falling flow path communicating with the second dust collection unit therebetween.

The body may be provided by a number of the axial inlet type swirl tubes, and end portions of the respective outlet sides of two bodies provided adjacent to each other may be arranged to be in contact with each other, and end portions of the respective outlet sides of two bodies in contact with each other and the outlet base may be spaced from each other to form the fine dust falling flow path therebetween. The air outlet and the fine dust falling flow path may be alternately formed along the outlet base.

The axial inlet type swirl tubes may be divided into a plurality of groups according to a direction in which the inlet faces, and the outlet of the axial inlet type swirl tube belonging to any one group may be provided to face the outlet of the axial inlet type swirl tube belonging to another group.

The axial inlet type swirl tubes may be divided into a plurality of groups according to a direction in which the inlet faces, and an arrangement angle formed between adjacent two groups based on the center of a region defined by the housing may be constant.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present disclosure.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dust collector, comprising:

a housing configured to form an outer appearance of the dust collector;

a cyclone provided inside the housing and configured to form a first swirling flow to separate dust from air introduced into the housing;

axial inlet type cyclones configured to receive air and fine dust that have passed through the cyclone, and to form second swirling flows to separate the fine dust from the air, the axial inlet type cyclones having inlets to receive the air and the fine dust, and outlets to output the air and the separated fine dust; and a mesh provided outside of the axial inlet type cyclones and configured to form a boundary between the cyclone and the axial inlet type cyclones, wherein the axial inlet type cyclones are stacked in multiple stages inside the cyclone and oriented such that the inlets face an inner surface of the mesh and the outlets face a central region defined by the housing, wherein air discharged from the axial inlet type cyclones moves to intersect in the central region defined by the housing and rises to an upper section of the housing, wherein each of the outlets of the axial inlet type cyclones includes an air outlet and a fine dust outlet that open toward a same direction, and wherein each of the axial inlet type cyclones includes:

a body having a cylindrical shape; and an outlet partition provided at an outlet side of the body, and formed in a cylindrical shape to partition the air outlet and the fine dust outlet formed around the air outlet.

2. The dust collector of claim 1, wherein each of the inlets is open toward a direction that is opposite to corresponding ones of the air outlets and the fine dust outlets.

3. The dust collector of claim 2, wherein the fine dust outlet is formed in a ring shape around the air outlet.

4. The dust collector of claim 2, wherein each of the axial inlet type cyclones further includes:

a vortex finder provided on an inlet side of the body, and provided with a cylindrically-shaped first surface and a cone-shaped second surface protruded from the first surface toward an outlet side of the body; and a vane formed between an outer circumferential surface of the first surface of the vortex finder and an inner circumferential surface of the body, and extended in a spiral direction.

5. The dust collector of claim 4, wherein one or more of the axial inlet type cyclones are formed by coupling a first member and a second member, and the first member forms the body, the vortex finder, and the vane of each of the one or more axial inlet type cyclones, and the second member forms the outlet partition of each of the one or more axial inlet type cyclones, and at least a portion of the outlet partition is inserted into the outlet side of the body.

6. The dust collector of claim 5, wherein the first member further includes a curved or planar body base, and the body extends through the body base, and the second member further includes an outlet base having a curved or planar shape, and the outlet base is formed with a quantity of air vent holes corresponding to a quantity of the axial inlet type cyclones, and the outlet partition is protruded from a periphery of the air vent hole toward an inside of the body.

7. The dust collector of claim 6, wherein the outlet base corresponds to at least one lateral surface of a cylindrical or polygonal pillar, and a rising flow path of air discharged from the axial inlet type cyclones is formed in a region surrounded by the outlet base, and the rising flow path communicates with an outlet of the dust collector formed on the upper section of the housing.

8. The dust collector of claim 7, wherein the mesh is provided in an inner region of the housing, and the axial inlet type cyclones are provided in an inner region of the mesh, and the rising flow path is formed in a region surrounded by the axial inlet type cyclones.

9. The dust collector of claim 7, wherein the dust collector further comprises:

a first dust collection chamber formed in a ring shape inside the housing, and configured to collect dust falling from the cyclone; and a second dust collection chamber formed in a region surrounded by the first dust collection chamber, and formed to collect fine dust falling from the axial inlet type cyclones, wherein the second member further includes a lower block surface provided between the second dust collection chamber and the rising flow path to prevent fine dust collected in the second dust collection chamber from being scattered to the rising flow path, and the lower block surface corresponds to a bottom side of the cylindrical or polygonal pillar.

10. The dust collector of claim 5, wherein the dust collector further comprises a frame that fixes the first member and the second member, and the frame includes:

an upper rim having a circular or polygonal shape;

a lower rim having a same shape as the upper rim, and being spaced apart from the upper rim; and one or more pillars extended along a height direction of the dust collector to connect the upper rim and the lower rim, and the pillars being spaced apart from each other to form at least one hole on a lateral surface of the frame.

11. The dust collector of claim 10, wherein the frame further includes a ring-shaped second dust collection chamber top cover that is extended in a circumferential direction from the lower rim.

12. The dust collector of claim 10, wherein the first member is inserted in a lateral direction of the frame through one of the holes formed between the pillars and is fixed to the frame.

13. The dust collector of claim 12, wherein the first member further includes a planar or curved body base that fixes the respective bodies of the one or more axial inlet type cyclones, and the body base is configured to block the hole in the frame.

14. The dust collector of claim 10, wherein the axial inlet type cyclones are formed in a plurality of groups, for each of the groups, the inlets of ones of the axial inlet type cyclones included in the group face a respective same direction, and the dust collector comprises a plurality of first members that are associated with, respectively, the groups of the axial inlet type cyclones, and the first members for the groups are inserted, respectively, into the holes of the frame.

15. The dust collector of claim 10, wherein the second member is inserted from an upper side of the frame through a hole defined by the upper rim, and mounted on the upper rim, and the second member further includes:

a planar or curved outlet base that fixes the outlet partition; and an upper block surface formed at an upper end of the outlet base to be mountable on the upper rim to prevent the mixing of air and fine dust discharged from the axial inlet type cyclones.

16. The dust collector of claim 6, wherein the dust collector further comprises:

a first dust collection chamber formed in a ring shape inside the housing and formed to collect the dust separated by the cyclone; and a second dust collection chamber formed in a region surrounded by the first dust collection chamber, and formed to collect fine dust separated by the axial inlet type cyclones, and wherein an end portion of the outlet side of the body and the outlet base are spaced apart from each other to form a fine dust falling flow path communicating with the second dust collection chamber.

17. The dust collector of claim 16, wherein end portions of the respective outlet sides of two of the bodies provided adjacent to each other are positioned to be in contact with each other, and the end portions of the respective outlet sides of the two bodies in contact with each other and the outlet base are spaced from each other to form the fine dust falling flow path therebetween.

18. The dust collector of claim 16, wherein the air outlets and the fine dust falling flow path are alternately formed along the outlet base.

19. The dust collector of claim 1, wherein the axial inlet type cyclones are divided into a plurality of groups according to directions in which the inlets face, and the outlet of one of the axial inlet type clones belonging to any one group is provided to face the outlet of another of the axial inlet type clones belonging to another group.

20. The dust collector of claim 1, wherein the axial inlet type cyclones are divided into a plurality of groups according to respect directions in which the inlets faces, and an arrangement angle formed between the adjacent ones of the groups and the central region defined by the housing is constant.

* * * * *